US008154376B2

(12) United States Patent
Aberin et al.

(10) Patent No.: US 8,154,376 B2
(45) Date of Patent: Apr. 10, 2012

(54) FUSES WITH SLOTTED FUSE BODIES

(75) Inventors: Edwin Aberin, Batangas (PH); Edwin Silvederio, Olongapo (PH); Jerico Caliboso, Batangas (PH); Albert Enriquez, Bulacan (PH); Ronald Auza, Bohol (PH)

(73) Assignee: Littelfuse, Inc., Chicago, IL (US)

( * ) Notice: Subject to any disclaimer, the term of this patent is extended or adjusted under 35 U.S.C. 154(b) by 31 days.

(21) Appl. No.: 11/856,704

(22) Filed: Sep. 17, 2007

(65) Prior Publication Data

US 2009/0072943 A1 Mar. 19, 2009

(51) Int. Cl.
*H01H 85/20* (2006.01)
*H01H 69/02* (2006.01)

(52) U.S. Cl. ..... 337/249; 337/186; 337/228; 337/248; 337/250; 337/272; 29/623

(58) Field of Classification Search ..... 337/186, 337/228, 248, 249, 250, 272, 281; 29/623
See application file for complete search history.

(56) References Cited

U.S. PATENT DOCUMENTS 1,773,182 A * 8/1930 Hickey ..... 337/250
1,773,184 A * 8/1930 Hickey ..... 337/250
1,831,002 A * 11/1931 Hickey ..... 337/247
1,902,568 A 3/1933 Maxam
1,904,691 A 4/1933 Magee
2,640,125 A 5/1953 Eggers
3,460,086 A * 8/1969 Fister ..... 337/202
3,601,574 A 8/1971 Fiddler
3,644,861 A 2/1972 Fister
3,719,912 A 3/1973 Harner et al.
3,735,309 A 5/1973 Hurtle
3,775,723 A 11/1973 Mamrick et al.
3,775,724 A 11/1973 Mamrick et al.
3,797,393 A 3/1974 Marchandise et al.
3,801,947 A 4/1974 Blewitt et al.
3,810,061 A 5/1974 Salzer
3,810,063 A 5/1974 Blewitt
3,839,786 A 10/1974 Salzer
3,849,142 A 11/1974 Conwicke
3,875,542 A 4/1975 Holland et al.
3,878,423 A 4/1975 Hill et al.
3,913,050 A 10/1975 Mikulecky
3,943,009 A 3/1976 Hipp
3,976,967 A 8/1976 Magherini
4,034,329 A 7/1977 Arikawa et al.
4,056,884 A 11/1977 Williamson et al.
4,057,774 A 11/1977 Arikawa et al.
4,080,039 A 3/1978 Ahroni et al.
4,099,153 A 7/1978 Cameron
(Continued)

FOREIGN PATENT DOCUMENTS

GB 574822 1/1946
(Continued)

*Primary Examiner* — Anatoly Vortman
(74) *Attorney, Agent, or Firm* — Kacvinsky Daisak, PLLC.

(57) ABSTRACT

A configuration for fuses and a method of manufacturing is disclosed. A fuse body is made with slots on the ends, allowing solder a greater surface area to grip the body and form an excellent bond. The slots communicate with a central cavity in the fuse body. The improvements relate primarily to surface mount fuses because of the great volume of such fuses in commerce, but may be applied to fuses of any size.

10 Claims, 3 Drawing Sheets

U.S. PATENT DOCUMENTS

| | | | | | |
|---|---|---|---|---|---|
| 4,099,320 | A | | 7/1978 | Schmitdt et al. | |
| 4,100,523 | A | | 7/1978 | Arikawa et al. | |
| 4,101,860 | A | | 7/1978 | Fister | |
| 4,107,759 | A | | 8/1978 | Shirn et al. | |
| 4,122,426 | A | | 10/1978 | Maruo | |
| 4,161,712 | A | * | 7/1979 | Thiel | 337/159 |
| 4,178,061 | A | | 12/1979 | Ahroni | |
| 4,183,004 | A | | 1/1980 | Kozacka | |
| 4,193,106 | A | | 3/1980 | Coleman | |
| 4,219,793 | A | * | 8/1980 | Kawamura | 337/228 |
| 4,224,592 | A | | 9/1980 | Urani et al. | |
| 4,297,666 | A | * | 10/1981 | Asdollahi | 337/163 |
| 4,329,006 | A | | 5/1982 | Gale | |
| 4,375,630 | A | | 3/1983 | Gaia | |
| 4,398,124 | A | | 8/1983 | Kohl et al. | |
| 4,409,729 | A | | 10/1983 | Shah | |
| 4,417,226 | A | | 11/1983 | Asdollahi et al. | |
| 4,445,106 | A | | 4/1984 | Shah | |
| 4,467,308 | A | * | 8/1984 | Arikawa et al. | 337/231 |
| 4,513,807 | A | | 4/1985 | Rose et al. | |
| 4,532,489 | A | * | 7/1985 | Phillips | 337/228 |
| 4,540,969 | A | | 9/1985 | Sugar | |
| 4,570,104 | A | | 2/1986 | Janssen et al. | |
| 4,612,529 | A | | 9/1986 | Gurevich et al. | |
| 4,656,453 | A | * | 4/1987 | Reeder | 337/236 |
| 4,698,454 | A | | 10/1987 | Moore | |
| 4,703,299 | A | * | 10/1987 | Vermij | 337/158 |
| 4,713,644 | A | | 12/1987 | Nash et al. | |
| 4,715,283 | A | | 12/1987 | Yengst | |
| 4,724,305 | A | | 2/1988 | Iimura et al. | |
| 4,751,489 | A | | 6/1988 | Spaunhorst | |
| 4,760,367 | A | | 7/1988 | Williams | |
| 4,769,902 | A | | 9/1988 | Mehta et al. | |
| 4,771,260 | A | | 9/1988 | Gurevich | |
| 4,855,705 | A | | 8/1989 | Narancic et al. | |
| RE33,137 | E | | 12/1989 | Gurevich et al. | |
| 4,890,380 | A | | 1/1990 | Narancic et al. | |
| 4,918,420 | A | * | 4/1990 | Sexton | 337/205 |
| 4,920,327 | A | * | 4/1990 | Arikawa et al. | 337/231 |
| 4,926,153 | A | | 5/1990 | Gurevich | |
| 4,928,384 | A | | 5/1990 | Gurevich | |
| 4,963,850 | A | | 10/1990 | Ranjan et al. | |
| 4,972,170 | A | * | 11/1990 | Ehlmann et al. | 337/228 |
| 4,996,509 | A | * | 2/1991 | Bernstein | 337/232 |
| 5,198,792 | A | * | 3/1993 | Bacon et al. | 337/251 |
| 5,214,406 | A | * | 5/1993 | Reese et al. | 337/231 |
| 5,235,307 | A | * | 8/1993 | Oh | 337/228 |
| 5,280,261 | A | * | 1/1994 | Mollet | 337/158 |
| 5,453,726 | A | | 9/1995 | Montgomery | |
| 5,596,306 | A | * | 1/1997 | Kowalik et al. | 337/282 |
| 5,642,090 | A | * | 6/1997 | Arikawa | 337/297 |
| 5,663,702 | A | | 9/1997 | Shaw, Jr. et al. | |
| 5,726,620 | A | * | 3/1998 | Arikawa | 337/227 |
| 5,739,740 | A | * | 4/1998 | Stark et al. | 337/248 |
| 5,760,676 | A | | 6/1998 | Yamada | |
| 5,770,994 | A | | 6/1998 | Evans | |
| 5,898,358 | A | | 4/1999 | Tompkins et al. | |
| 5,905,426 | A | * | 5/1999 | Douglass | 337/229 |
| 5,926,084 | A | | 7/1999 | Frochte | |
| 5,963,123 | A | * | 10/1999 | Douglass | 337/254 |
| 5,994,994 | A | * | 11/1999 | Ito et al. | 337/248 |
| 6,133,819 | A | | 10/2000 | Comberg et al. | |
| 6,207,938 | B1 | | 3/2001 | Taylor et al. | |
| 6,269,745 | B1 | | 8/2001 | Cieplik et al. | |
| 6,552,646 | B1 | * | 4/2003 | Wong | 337/252 |
| 6,577,486 | B1 | | 6/2003 | Nishimiya et al. | |
| 6,639,188 | B2 | | 10/2003 | Ito | |
| 6,650,223 | B1 | | 11/2003 | Jollenbeck et al. | |
| 6,798,330 | B2 | | 9/2004 | Arikawa et al. | |
| 6,856,092 | B2 | | 2/2005 | Pothoven et al. | |
| 6,917,020 | B2 | | 7/2005 | Ito | |
| 7,094,371 | B2 | | 8/2006 | Lo | |
| 7,138,899 | B2 | * | 11/2006 | Jollenbeck et al. | 337/281 |
| 7,172,984 | B2 | | 2/2007 | Zolnier et al. | |
| 7,250,843 | B2 | * | 7/2007 | Richter et al. | 337/250 |
| 7,320,171 | B2 | * | 1/2008 | Jollenbeck et al. | 29/623 |
| 2008/0084267 | A1 | * | 4/2008 | Jollenbeck et al. | 337/246 |

FOREIGN PATENT DOCUMENTS

| | | | | |
|---|---|---|---|---|
| GB | 807755 | | | 1/1959 |
| GB | 1176004 | | | 1/1970 |
| JP | 03062429 | A | * | 3/1991 |

* cited by examiner

FUSES WITH SLOTTED FUSE BODIES

BACKGROUND

Fuses have long been necessary parts of electrical circuits, providing quick protection of circuits from overloads. Many fuses have parts that are familiar, as shown in U.S. Pat. No. 4,560,971. A fuse includes a fuse body, a conductor or fuse element within the body, and two end caps or ferrules for connection into a fuseholder or other connecting portions of a circuit. Of course, these same parts may be used in fuses large and small, and also for loads large and small. However, as circuits and circuitry get smaller, fuses also need to reduce their size. See, for example, the Nano$^2$® Fuse series from Littelfuse, Inc., intended for use on very small surface-mounted circuits, in which many parts are actually printed onto the substrate.

When working with large fuses, it is relatively simply to assemble the fuse. The fuse element may be several inches long, as is the body, and the ferrules or other termination may be ½ inch (about 1.3 cm) or larger in diameter. Placing the parts together, by hand or in fixtures, is relatively simple and is easily accomplished. However, when the entire fuse is much reduced in size, such as fuses intended for surface-mount applications, the difficulty is increased. Many of the fuses in the above-mentioned series are less than ½ inch (about 1.3 cm) in length, and may be only about ⅛ of an inch (about 0.3 cm) in both width and depth. These small sizes are necessary to conform to the scale of the circuitry in surface-mount technology.

It is challenging to assemble reliable fuses on this small scale, principally because the requirements for reliability are high, while the size of the fuse, and all its internal bonds are small. The consistency and reliability of solder bonds are very important characteristics that must be built into the fuse. X-rays or other inspection techniques may occasionally reveal fuses which have inferior bonds. However, the trend in manufacturing is not to inspect quality into the parts, but rather to design a process in which reliability is almost inherent. That is, the present manufacturing process continually strives to consistently attain 100% reliable fuse products. Of course, the structure of a fuse, and the process for making the fuse, may vary drastically from the process described here. See, e.g., the fuses and the processes described in U.S. Pat. No. 5,977,860, and in U.S. Pat. No. 6,002,322. Fuses described in these patents are made by entirely different processes, Without being bound to any particular theory, it is believed that the problem with the present process is that assembly requires the application of consistent external force and air pressure to reliably fit and bond the parts together. This presents no problem with the first end cap, because the opposite end is still open, allowing gas to escape. When the second end cap is secured, however, it is believed that this process traps pressurized air inside the fuse body. The pressurized gas exerts a force on the end caps, tending to move them off the fuse body. To control this, both external force and air pressure are applied. The external force holds the fuse parts together while the external air pressure will balance the pressure inside the fuse and prevent solder from coming out of the fuse assembly. This part of the process is important for attaining reliable bonds and is not easy to consistently control. Any undesirable variation in the operations will lead to inferior bonds.

The present invention is directed to solving this problem by using improved fuse components and a better process.

SUMMARY

There are many embodiments of the present invention. One embodiment is a fuse. The fuse includes a hollow body having two ends and at least one slot on both ends, the slots and a central cavity of the hollow body forming a continuum allowing passage of gasses or air from the central cavity to an outer surface of the body, a metallic element passing through the body, and a metallic cap on both ends in electrical communication with the wire, wherein when the fuse is assembled, the slots are closed and the central cavity does not communicate to the outer surface of the body. The metallic element may be a wire.

Another embodiment is a fuse. The fuse includes a hollow body having an inner surface, the body having two ends and at least two slots on each end in communication with the inner surface, a metallic wire extending through the hollow body, and a metallic cap soldered on each end and joined to the metallic wire.

Yet another embodiment is also a fuse. The fuse includes a hollow ceramic body having an inner surface, the body having two ends with at least one slot on at least one end, the at least one slot extending from the inner surface to an outer surface of the end, a metallic element extending through the body, and a metallic cap sealed to each end of the body.

Another embodiment is a method of making a fuse. The method includes a step of providing a hollow fuse body with first and second ends and a slot on at least one of the ends, the at least one slot in communication with a central cavity of the hollow fuse body, joining the body to a first metallic cap on the first end, connecting a metallic element to the first metallic cap, the metallic element extending through the body, and joining a second metallic cap to the metallic element and to the second end.

Additional features and advantages are described herein, and will be apparent from, the following Detailed Description and the figures.

DETAILED DESCRIPTION

There are many embodiments of the invention, of which the embodiments depicted and described herein are only a few examples. The fuses with hollow slotted bodies are preferably used for surface-mount applications, because these fuses are easily adapted to mass manufacturing techniques. In some embodiments, the fuses depicted herein are relatively small, for example, about 11 mm long (about 0.4 inches) and are have a cross section generally in the form of a square, a square with rounded corners, a circle, a rectangle, or a rectangle with rounded corners, and having a body width/depth of about 2.9 mm and a cap width/depth of about 3.1 mm. Other sizes may be used. The solder pads prepared for these fuses are preferably two square pads about 3.4 mm wide by about 3.2 mm long, such that both pads fit into a length about 12.6 mm (about ½ inch) long. Other sizes and configurations may be used.

Figure 1:
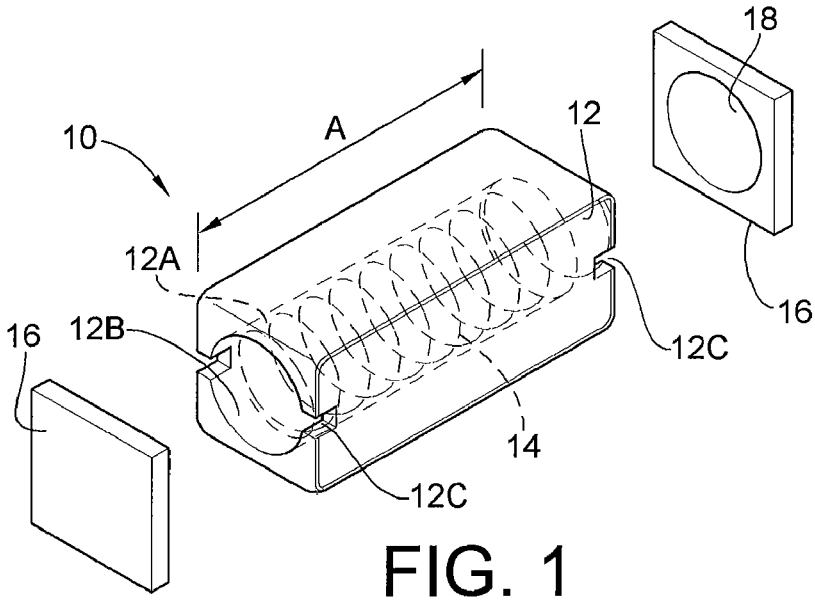
FIG. 1 depicts a first embodiment of a fuse having a hollow fuse body with slots.

A first embodiment of a fuse is shown and described in FIG. 1. Fuse 10 includes a hollow ceramic body 12. Ceramic body 12 is an elongated tube having a cross section with an outer shape of a rounded square and an inner portion 12*a* with a cross section of a circle. Inner portion 12*a* extends the length of the body 12 along longitudinal axis A, and the ends of the body 12*b* include transverse slots 12*c*. The slots in this instance extend from the inner portion 12*a* to the outer side surface. The fuse also includes an inner wire 14 in the form of a helical spring. The spring is secured to end caps 16 with solder 18 on both ends. Solder 18 is in the form of a solder dome, each end formed separately and under force and pressure to form such a dome. Once the end caps are soldered or sealed to the ceramic body, the slots are covered by the end cap and at least partially filled with solder, braze, or the like, to substantially seal the device. The inner portion or cavity 12*a* may instead have another desired shape, such as a square, rectangle, or triangle, preferably with rounded corners.

The hollow body is preferably ceramic, such as aluminum oxide, alumina, but may instead be made from mullite or other insulative, inexpensive and available materials. The body may also be made from a glass-ceramic material, from glass, or from virtually any non-conductive material that is capable of service in this application. Even a plastic or fiberglass body could work, so long as the material is capable of withstanding soldering temperatures or other processing temperatures typically involved in the fabrication of printed circuit boards, especially surface-mount type printed circuit boards. The end caps are silver-plated brass, for excellent conductivity and ease of soldering, but they could also be gold plated, tin/lead plated or plated with another suitable material. Solder suitable for the application and temperatures involved should be used. While solder is clearly preferred, other methods of attachment could be used, such as welding or brazing, for instance for very high temperature applications.

Figure 2:
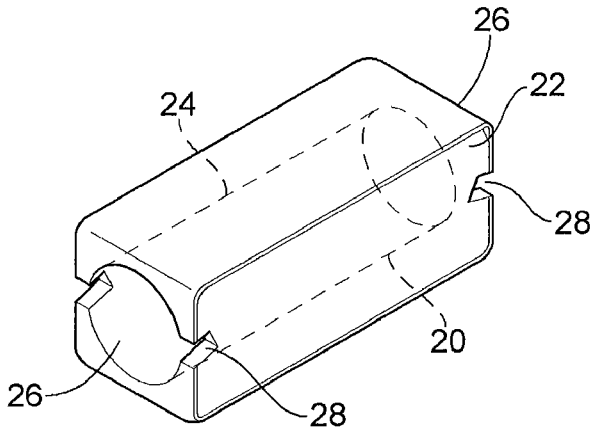
FIGS. 2-3 depict alternate embodiments of hollow fuse bodies with slots.
Figure 3:
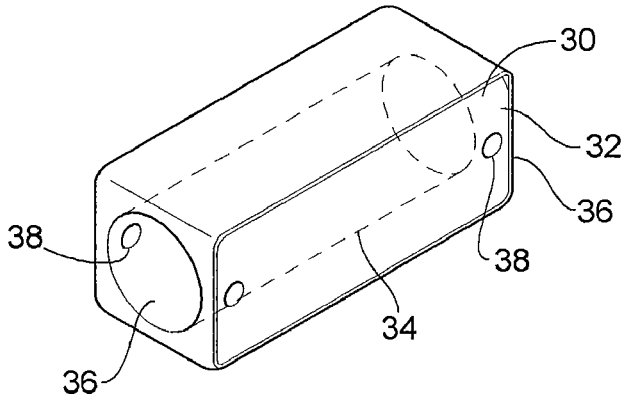

In addition to the embodiment of FIG. 1, other configurations of a slotted body may be used, as shown in FIGS. 2-3. In FIG. 2, hollow body 20 has an outer form 22 in the shape of a rounded square and an inner surface 24 in the shape of a cylinder, i.e., a cross section of a circle. Of course, in other embodiments, the inner surface may have a cross section of a square, rectangle, rounded square, rounded rectangle, and so forth. The hollow inner portion extends to both ends 26. The ends have slots 28 which extend and communicate from the inner portion to the outer surface 22. In this instance, the slots are formed at an angle to the longitudinal axis A of the body, while in the embodiment of FIG. 1, the slots extended along the longitudinal axis of the body. It has been found in experimental work that using the angled slots results in increased strength of the bond between the end caps and the body.

Without being bound to any particular theory, it is believed that the slots enable gasses within the hollow body to escape from the body during the placing and bonding of the second cap. The process, as will be explained below, includes the application of force during bonding. If pressurized gas remains within the body after the solder flow is complete, the pressurized gas will tend to urge the cap away from the body and may result in inferior bonds. It is believed that the slots allow the gas to escape during the solder process, thus eliminating the problem of trapped, pressurized gas. As a result, only one end of the fuse need have slots, the end that is bonded and soldered second. However, with modern mass production and material handing techniques, it will be tedious to align fuse bodies so that the end without a slot is capped and soldered first while the end with the slot is capped and soldered second. Thus, even though it is believed that the advantage will accrue with a single slot, it is easier and more practical to have a slot on both ends.

As mentioned, it is believed that the purpose served by the slot is to allow air from the hollow center to escape. Thus, the slot needs to connect the inner hollow to the outside of the fuse body. Another embodiment that meets this requirement is depicted in FIG. 3. Hollow fuse body 30 has a central cylindrical cavity or void 32 and an outer surface 34. The central cavity 32 extends to both ends 36. Near the ends, slots 38 connect to the central cavity 32, forming a continuum between the inside of the hollow fuse body and the outer surface. Note that the other embodiments described thus far also form such a continuum between the inside of the fuse body and its outer side surface. Of course, once the assembly and soldering are completed, the slots are filled and this continuum, now covered by the end cap and at least partially filled with solder, ceases.

Many fuses have been made and tested with the new slotted bodies. In order to form a fuse that will not fail mechanically during or after assembly to a printed circuit board, it is desired that the bond strength between the cap and the body can withstand an axial force of at least 2 lbs. The average force for caps made with bodies without slots is about 3.5 lbs. However, even with this excellent performance, there are outliers that may fail during assembly to a printed circuit board, or may fail later in service. Tests made with the embodiment of FIG. 1 have an average pull test of about 9.5 lbs. Tests made with the embodiment of FIG. 2 have an average pull test of about 10.5 lbs. In x-ray inspections, the appearance of fuses made with slotted bodies shows much better uniformity of the solder joint between the caps and the body. In addition, the helical wire within the body typically shows better alignment along the longitudinal axis of the fuse body. Finally, there have been virtually no failures of these slotted fuses during and after assembly to circuit boards in testing done to date.

Figure 4:
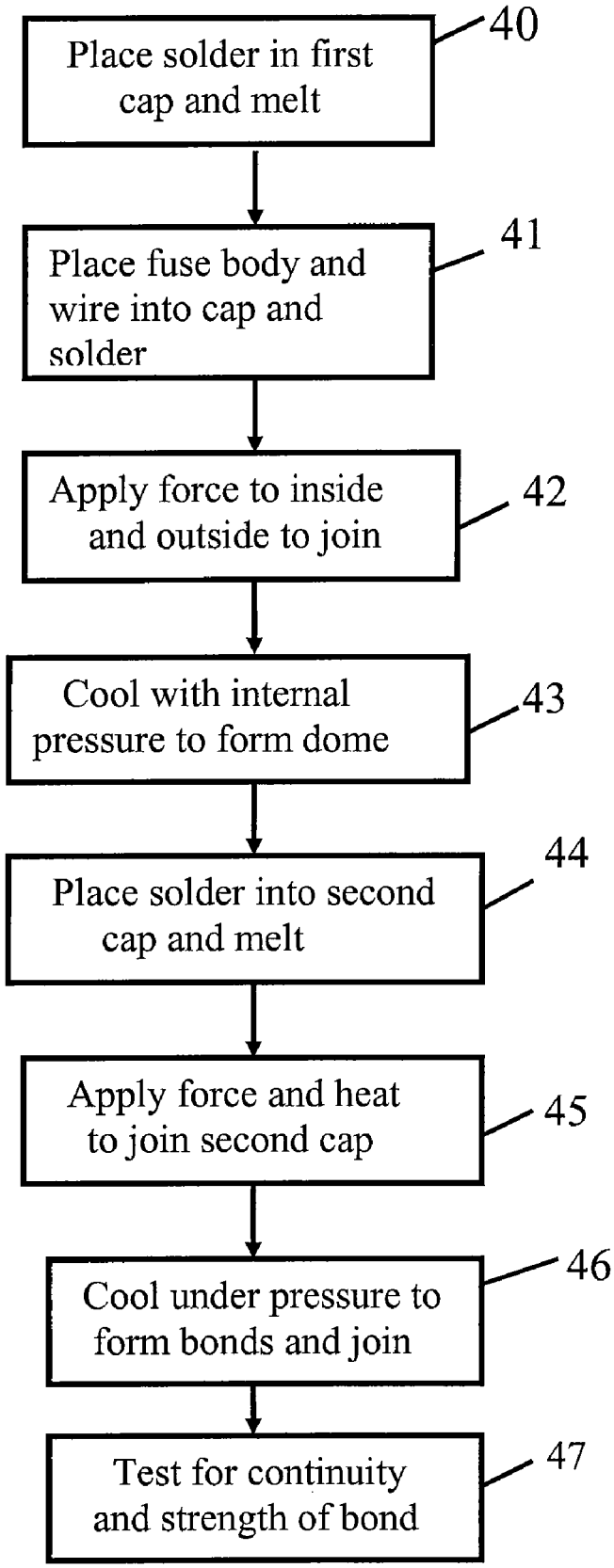
FIG. 4 is a flowchart for a method of making fuses with hollow fuse bodies having slots.

A method of making fuses using the new slotted bodies is depicted in the flowchart of FIG. 4. In order to join the first end cap to the fuse body, solder is placed in an inverted fuse cap, which is warmed to melt 40 and distribute the solder. The fuse body and wire and then placed 41 and pressed 42 into the molten solder, under about 800 g. force placed on the end of the fuse body. They are then cooled 43 in a cooling chamber with about 16-22 psi to form a solder dome.

Solder is then placed 44 into the second end cap and melted, and heat is applied at atmospheric pressure 45 to join the other end of the fuse body to the second end cap. The body, now with a fuse wire and two end caps attached, is now cooled 46 in a sealed cooling chamber at about 16-22 psig to consolidate the bonds and form the fuse. This process takes about 1-2 minutes. Afterwards, a sample of the fuses are tested 47 to insure electrical continuity and the strength of the bond. Samples may also be x-rayed or subjected to other non-destructive testing to assure the strength and quality of the internal bonds.

Figure 5:
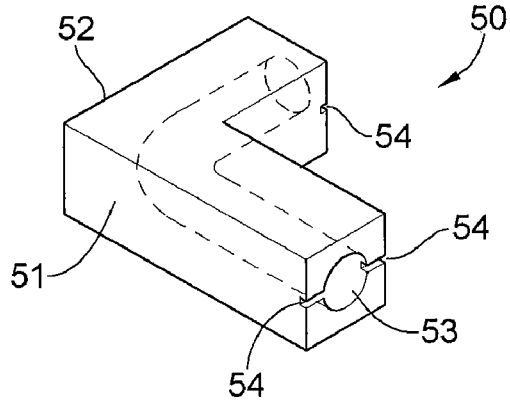
FIGS. 5-6 depict alternate embodiments of hollow fuse bodies with slots.
Figure 6:
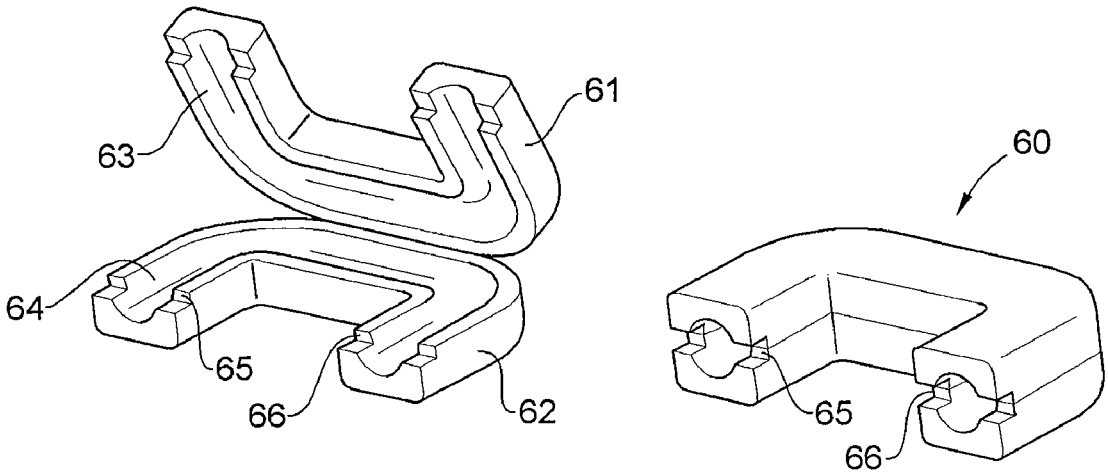

The shape of the fuse embodiments is not limited to straight, in-line embodiments as shown above. Other embodiments, as shown in FIGS. 5-6, may have the general shape of an "L" or a "C." In FIG. 5, fuse 50 has a fuse body in the shape of a capital L. The fuse includes a first fuse body length 51 and a second fuse body length 52 at least roughly perpendicular to the first fuse body length. The fuse includes a central cavity 53 and slots 54 communicating from the inside hollow to the outside. End caps (not shown) connect a fuse wire (not shown) after assembly, as discussed with the embodiments above.

FIG. 6 depicts another embodiment, a C-shaped fuse body 60. Ceramic body 60 may be made in two halves 61, 62 as shown, and then assembled, as by soldering, molding, or other joining technique. In this embodiment, portion 61 has slightly greater width and depth than portion 62, facilitating insertion of portion 62 into portion 61. The halves include a central cavity 63, 64, and slots 65, 66 to communicate between the inner hollow area and the outside of the fuse. In other embodiments that halves may be the same size.

It should be understood that various changes and modifications to the presently preferred embodiments described herein will be apparent to those skilled in the art. For example, most of the embodiments depict four slots, two on each end, at right angles to a longitudinal axis of the fuse body. It has been pointed out that angled slots may advantageously be used. In other embodiments, there may be three or four slots on each end, and the slots may go through the corners of the fuse body, rather than spanning them as shown. The slots are shown rather wide, but in some embodiments, the slots may be only a little wider than the width of the wire or fuse element used for the fuse. This may help retain solder within the body, helping to form the solder dome, during manufacturing. The slots themselves may have a cross section in the form of a circle, a portion of a circle, a rounded rectangle, a rounded square, a rounded trapezoid or a rounded parallelogram, or even a triangle.

Such changes and modifications can be made without departing from the spirit and scope of the present subject matter and without diminishing its intended advantages. It is therefore intended that such changes and modifications be covered by the appended claims.

What is claimed is:

1. A fuse, comprising:

a hollow body, said body having a first end and a second end and a longitudinal axis therebetween, first and second slots disposed at respective peripheral ends of the outer surface at each of the respective first and second ends, said first and second slots extending from said central cavity to said outer surface at said respective first and second ends, said first and second slots extending along the longitudinal axis;

a metallic element passing through the body from said first end to said second end;

a first metallic cap attached to the first end of the hollow body; and a second metallic cap attached to the second end of the hollow body, said first and second caps in electrical communication with the metallic element, wherein the second cap covers a first portion of said second slot on said second peripheral end area but does not cover a second portion of said second slot extending along the longitudinal axis;

wherein the second portion of the second slot is filled with solder or braze metal.

2. The fuse according to claim 1 further comprising solder disposed between at least a portion of said metallic element and each of the first and second metallic caps.

3. The fuse of claim 1, wherein the first and second slots are parallel to the longitudinal axis.

4. The fuse of claim 1, wherein the first and second slots are angled with respect to the longitudinal axis.

5. A method of making a fuse, the method comprising:

providing a hollow fuse body with first and second ends and a longitudinal axis therebetween, the first and second ends having respective first and second peripheral end areas, the hollow fuse body having respective first and second slots on each of the respective first and second peripheral end areas, the first and second slots extending along the longitudinal axis, the first and second slots in communication with a central cavity of the hollow fuse body;

joining the body to a first metallic cap on the first end;

connecting a metallic element to the first metallic cap, the element extending through the body; and joining a second metallic cap to the metallic element and to the second end of said hollow fuse body such that the second metallic cap covers a first portion of said second slot on said second peripheral end area but does not cover a second portion of said second slot extending along the longitudinal axis to thereby allow gasses within the hollow body to escape through said second portion during the joining of the second metallic cap to the second end of the hollow fuse body;

wherein the second portion of the second slot is filled with solder or braze metal during the joining step.

6. The method of claim 5, further comprising applying force during at least the second step of joining to force metal into the second end.

7. The method of claim 5, further comprising inverting the body between the step of connecting and the second step of joining.

8. The method of claim 5, wherein the steps of joining are accomplished with solder filling the first and second slots at the respective first and second ends and further comprising forming a solder dome on an inside of the first and second metallic caps.

9. The method of claim 5, wherein the first and second slots are parallel to the longitudinal axis.

10. The method of claim 5, wherein the first and second slots are angled with respect to the longitudinal axis.

* * * * *